US005421584A

United States Patent [19]

Planinc et al.

[11] Patent Number: 5,421,584

[45] Date of Patent: Jun. 6, 1995

[54] GAME APPARATUS

[75] Inventors: Alec Planinc; Klas Forsberg, both of Goteborg, Sweden

[73] Assignee: Freefun Holding L.L.C., New York, N.Y.

[21] Appl. No.: 317,768

[22] Filed: Oct. 4, 1994

[51] Int. Cl.[6] ..... A63B 67/00

[52] U.S. Cl. ..... 273/327; 273/338; 273/428

[58] Field of Search ..... 273/317, 318, 327, 336, 273/337, 338, 339, 412, 425, 428

[56] References Cited

U.S. PATENT DOCUMENTS

| | | | |
|---|---|---|---|
| 429,531 | 6/1890 | Johnstone | 273/327 X |
| 1,975,724 | 10/1934 | Jonas | 273/327 |
| 2,371,567 | 3/1945 | Wilson | 273/327 |
| 3,823,942 | 7/1974 | Duncan | 273/327 |
| 4,209,936 | 7/1980 | Sklar | 273/424 X |

FOREIGN PATENT DOCUMENTS

| | | | |
|---|---|---|---|
| 2361132 | 3/1978 | France . | |
| 9000336 | 9/1991 | Netherlands | 273/327 |
| 26439 | 7/1907 | United Kingdom | 273/327 |

*Primary Examiner*—William H. Grieb
*Attorney, Agent, or Firm*—Lieberman & Nowak

[57] ABSTRACT

Game apparatus comprising a ring with a flight stabilization member attached to the ring, with the axis of the flight stabilization member being generally parallel to the plane of the attached ring during flight. A launching device is used to launch the ring from a first player to a second player, and the characteristics of the ring and attached flight stabilization member cause the ring and attached flight stabilization member to rotate in flight, such that the ring can be caught by an opposing player and relaunched to the first player, or launched toward a target, providing greatly enhanced play value over prior art toys.

15 Claims, 12 Drawing Sheets

GAME APPARATUS

FIELD OF THE INVENTION

This invention relates generally to games of skill, playable indoors and outdoors, and, more particularly, to a game of skill having a ring which has attached thereto a flight stabilization member and a launching device. The ring and attached flight stabilization member are launched from a first player to a second player by the launching device, or launched at a target.

BACKGROUND OF THE INVENTION

Various games have existed in which one or more players utilized launching devices to launch a ring type device at a second player. For example, in U.S. Pat. No. 429,531 granted Jun. 3, 1890, there is described a game in which a ring is launched by one player by utilizing two rods inserted within the ring. By rapidly moving the rods away from each other, it was possible to launch the ring in the direction of a second player.

The game is played with the use of two goals and it is the objective of the game to launch the ring towards the opposing player and attempt to get the ring past the opposing player into the opposite goal. Points are scored for achieving this objective.

U.S. Pat. No. 1,975,724, granted on Oct. 2, 1934, describes a second type of game apparatus in which a projectile is launched into the air to be retrieved by the player who is operating the launching device. Alternatively, the projectile may be launched toward a second player who endeavors to receive it and return it to the first player. Each player is provided with a launching device with which to launch or to catch the ring. As described, the launching device consists of a pair of rods attached with a cord at a first end thereof. One rod is inserted into the ring with the ring then resting on the cord extending between the two rods. When the rods are rapidly pulled away from each other the ring is launched toward the opposing player.

Similarly, U.S. Pat. No. 2,371,567 describes a game of skill in which rings are launched toward opposing players by utilizing two rods held by a first player. The ring is launched by rapidly moving the rods away from each other to throw the ring toward the opposing player, with the objective being for the opposing player to catch the ring.

Finally, U.S. Pat. No. 3,823,942, granted on Jul. 16, 1974, describes a hoop game utilizing hoop assemblies intended to be pitched or thrown through the air toward a target where points are scored. In one embodiment of the invention, the hoops may be launched with two rods held by a player, and caught by the opposing player on a similar set of rods.

Although each of the foregoing references describe various games of skill in which rings or hoops are launched towards a goal or an opposing player, none of the references described provide the advantages of the instant invention.

It is, therefore, an object of the instant invention to provide game apparatus utilizing a ring type device launched from one player to a second player, or returned to the first player, which provides enhanced play value plus a great degree of skill in launching and catching the ring type device.

SUMMARY OF INVENTION

The instant invention is directed to game apparatus comprising a ring with an flight stabilization member attached to the ring and being essentially parallel to the plane of the ring in flight, and at least one launching device used by a first player for launching the ring to a second player.

It is a feature of the invention that the launching device may comprise a pair of longitudinally extending members joined together at a first end of each of the extending members, said joined first end being inserted into the ring for launching.

It is a further feature of the invention that the launching device may comprise a single longitudinally extending member hinged at a middle portion thereof, said hinged portion inserted into the ring for launching.

It is another feature of the invention that gripping handles are affixed to, or made part of, a second end of each of the extending members, the gripping handles being rapidly separated from each other by the player to launch the ring.

It is a still further feature of the invention that one of the extending members can be a cord and one a rod or a flexible rod or both extending members can be rods or flexible rods, or the launching device can be a single rod or flexible rod, or a single rod hinged at the middle thereof.

It is a further feature of the invention that the flight stabilization member can be an elongated tubular member attached to the ring with a first diameter at the end connected to the ring, and a second and smaller diameter at the end of the tubular member extending away from the ring.

It is another feature of the invention that the tubular member may be closed at the end extending away from the ring.

These and other objects and features of the invention will be more fully appreciated from the following detailed description, in conjunction with the accompanying drawings, in which:

DETAILED DESCRIPTION OF THE INVENTION

Figure 1:
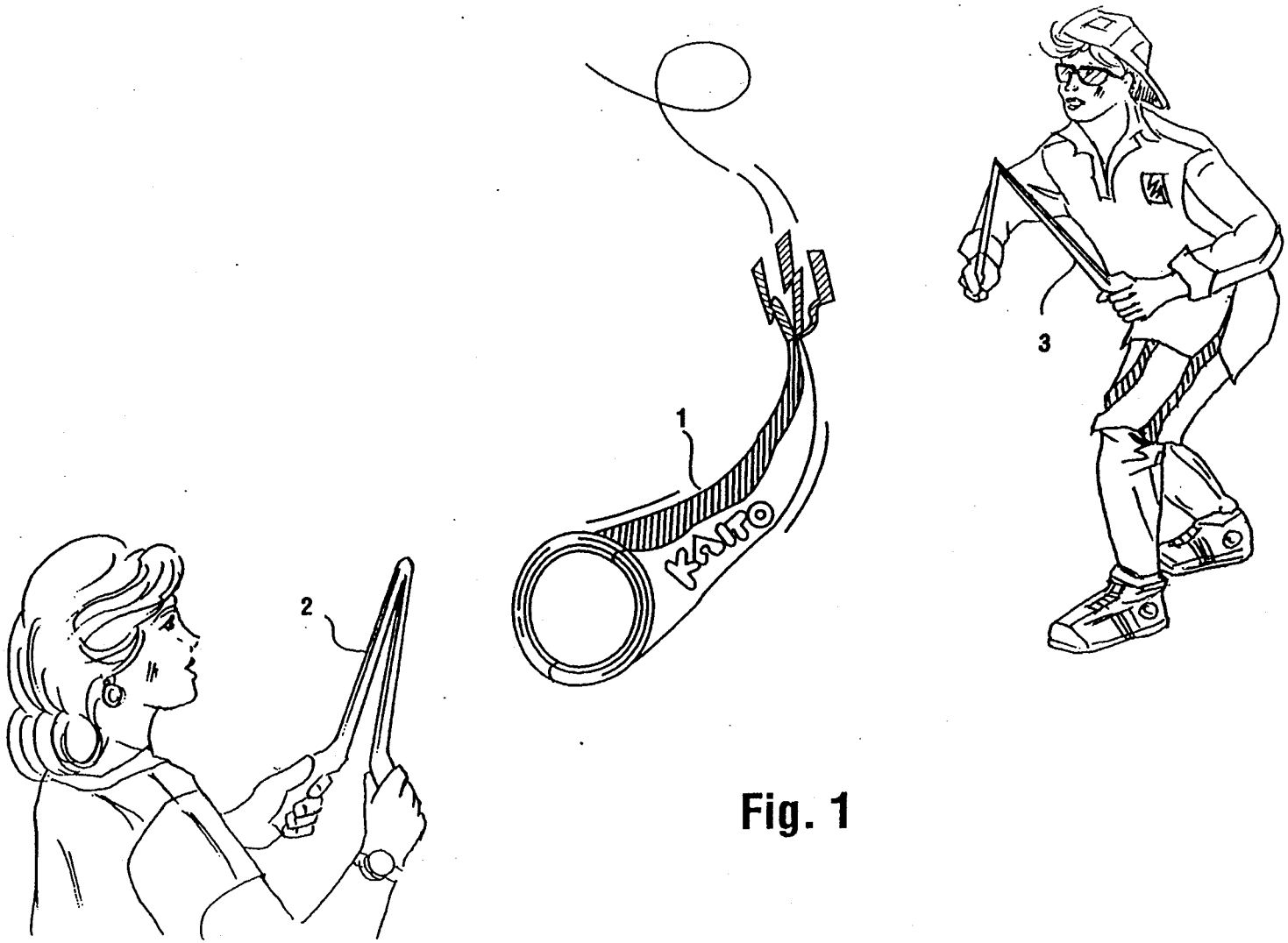
FIG. 1 illustrates one manner in which the game of the instant invention is played.
Figure 2:
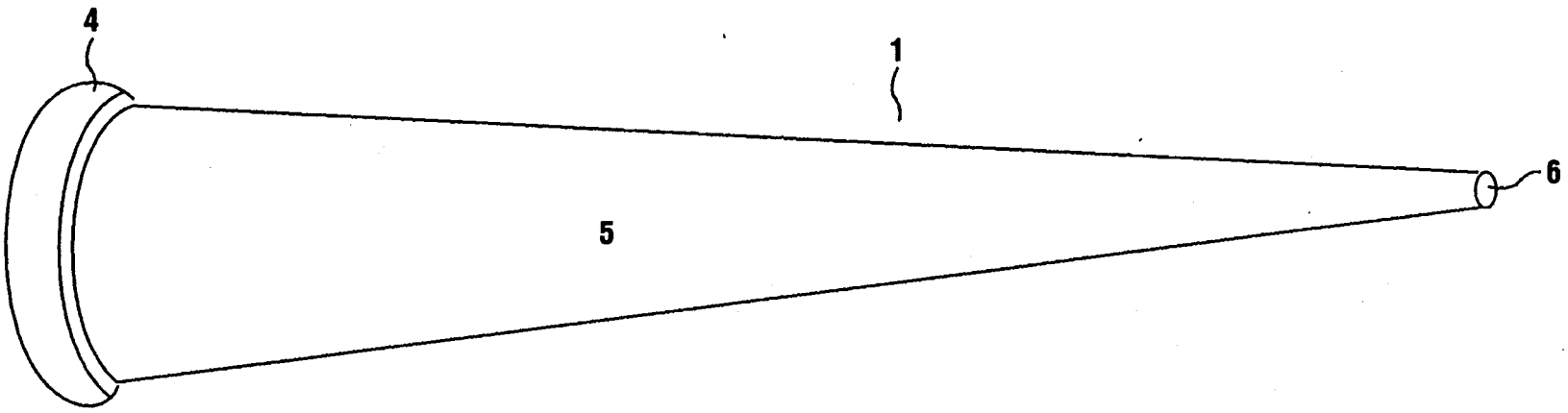
FIG. 2 illustrates the ring of the instant invention to which is attached a flight stabilization member which in this embodiment is an elongated tubular member.

Referring now to FIGS. 1 and 2, there is shown one manner in which the game of the instant invention may be played. More particularly, a ring 4, shown in FIG. 2, has attached thereto a flight stabilization member such as elongated tubular member 5. It is to be understood that the term "ring" as defined herein means a device that is substantially circular, but not limited to a perfect circle. The launching device used by the players consists of two elongated extending members 2 and 3 held by each player. As noted in FIG. 1, the ring to which is attached the elongated tubular member is directed by one player towards a second player, and the second player catches the ring and its associated tubular member on his or her launching device. To launch the ring, a player rapidly separates the handles attached to the launching device from each other, thereby launching the ring along with the tubular member to the opposing player.

As shown in FIG. 2, ring 4 has a first larger diameter to which is attached tubular member 5. At the opposite end of tubular member 5, there may be a second smaller diameter opening 6.

When the device shown in FIG. 2 is launched from one player to a second player, the ring, due to its weight, and the drag of the attached tubular member 5, causes the entire device shown in FIG. 2 to rotate during its flight through the air, such that when it reaches the opposing player the ring will be facing the opposing player as shown in FIG. 1. Due to this unique feature, the second player can easily and reliably catch the device and relaunch it toward the opposing player, thus giving great play value to the game. This feature will be further detailed with respect to FIG. 9.

Figure 3:
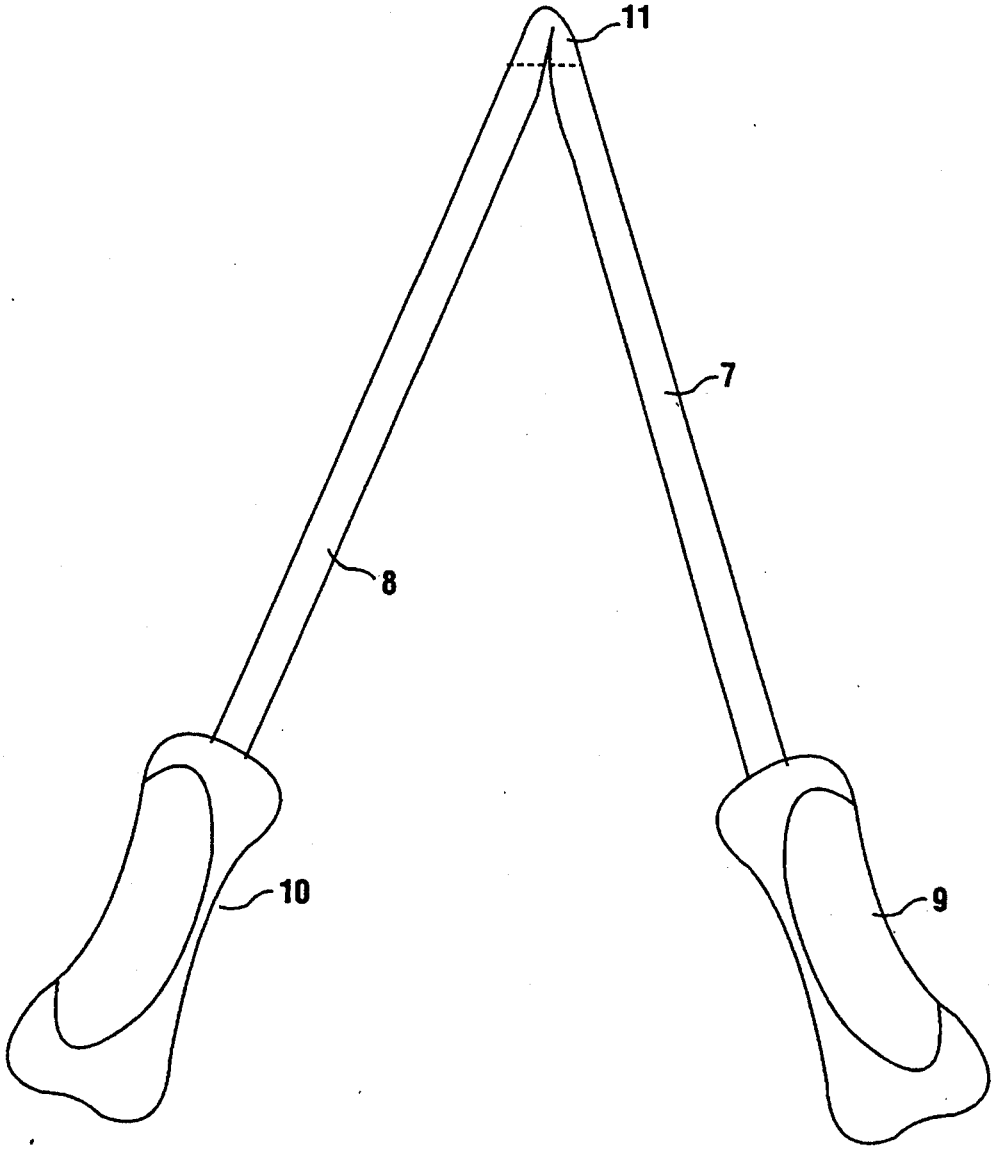
FIG. 3 illustrates one embodiment of the launching device.

Referring now to FIG. 3, there is shown, in greater detail, one embodiment of the launching device of the instant invention. As indicated, the launching device may consist of two flexible rods 7 and 8, which are joined together at a first end thereof shown at 11. It is to be understood that the area shown at 11 may be any type of hinge or flexible material, either made of the same material as rod 7 or 8, or of a different material which would be joined to rods 7 and 8 in an appropriate manner. The only requirement for hinge area 11 is that it be suitable for repeated use during play of the game without breakage or damage to the hinge. For example, rods 7 and 8, as well as hinge area 11, may be made of the same material with a fold point being utilized at area 11. Also shown in FIG. 3 are gripping handles 9 and 10, which are attached to rods 7 and 8 for ease of playing the game. It is to be understood that the gripping handles may also be made of the same material as rods 7 and 8, with the entire assembly being made in a single piece.

Figure 4:
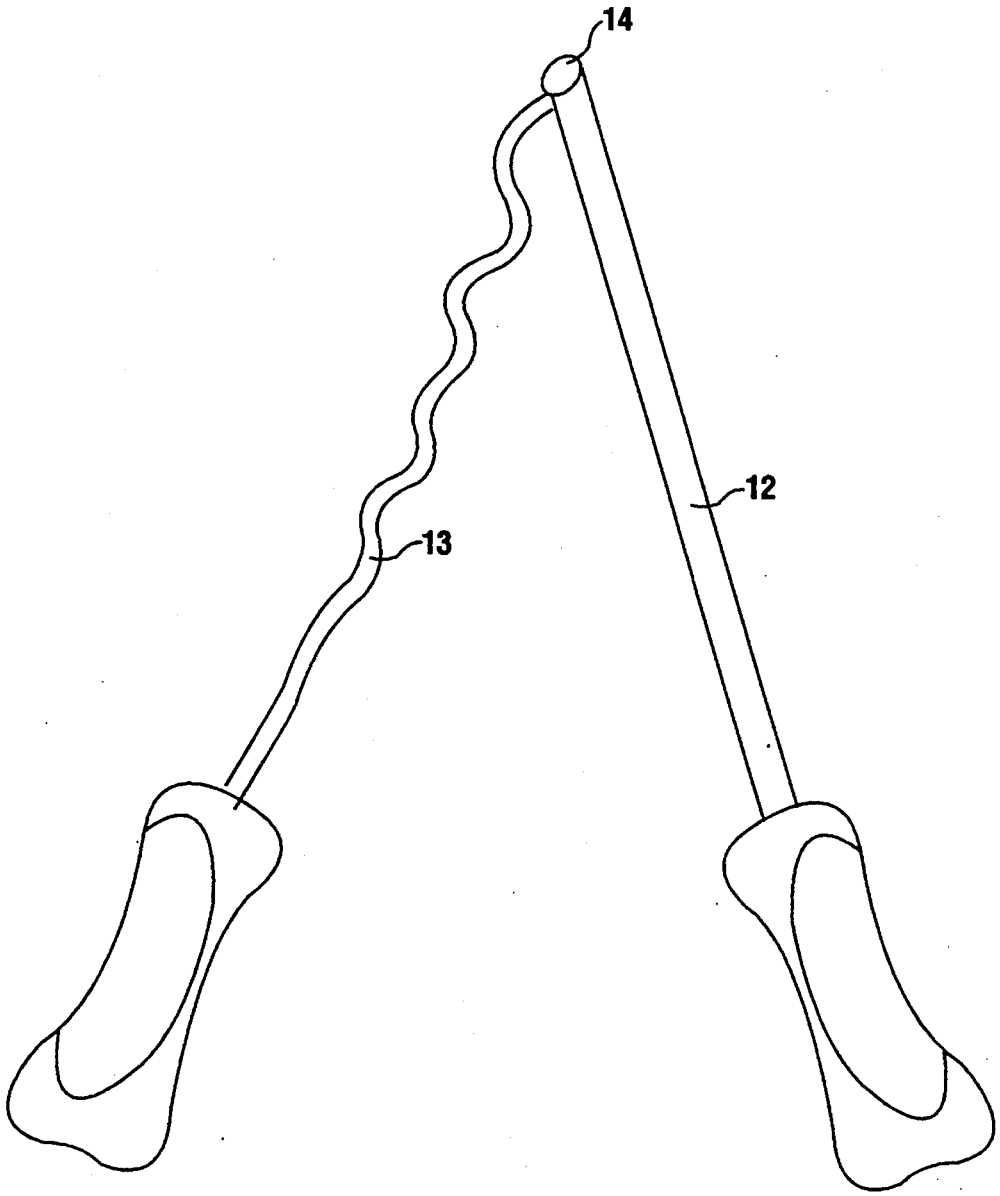
FIG. 4 illustrates a second embodiment of the launching device.

Referring now to FIG. 4, there is shown a second embodiment of the launching device. As indicated, this particular embodiment consists of rod 12 and cord 13, which are joined together at point 14. In this embodiment, the rod is inserted into the ring as before, and the player straightens cord 13 as an anchoring device and launches the ring along rod 12 toward the opposing player.

The material of the ring 4 can be any suitable low friction material, such as poly-propylene. Similar low friction material is also used for flexible rods 7 and 8. The only requirement is that a low friction interface is achieved between the launching rods and the ring, in order to generate sufficient speed when the device is launched from one player to the opposing player.

The material of flight stabilization member 5 can be, for example, nylon which is cut and stitched into an elongated tubular form. Other similar materials may be used, with the only requirement that the material be supple enough for turning when the ring is launched, but durable enough such that the material will not be damaged during repeated use. The material used may be doubled (i.e., two layers of material) in the area near the ring to thereby stiffen the material and prevent the material from collapsing into the ring during flight.

Various experiments were conducted to determine the optimum characteristics of the inventive game apparatus to achieve the greatest play value. For example, tests were conducted by varying the minimum diameter of the ring 4 between 90 and 125 millimeters. Various shapes of the tubular member 5 were also tried, including varying the length from between 250 and 900 millimeters. Also, the weight of the ring was varied between 50 and 180 grams. Based on these tests, as well as effective play with the game, it is determined that a preferred configuration for the ring is approximately a diameter of 100 millimeters, a width of approximately 30 millimeters, and a weight of 110 grams. Tubular member 5 preferably has a length of approximately 550 millimeters, with a diameter of the opening 6 being approximately 40 millimeters.

Figure 5:
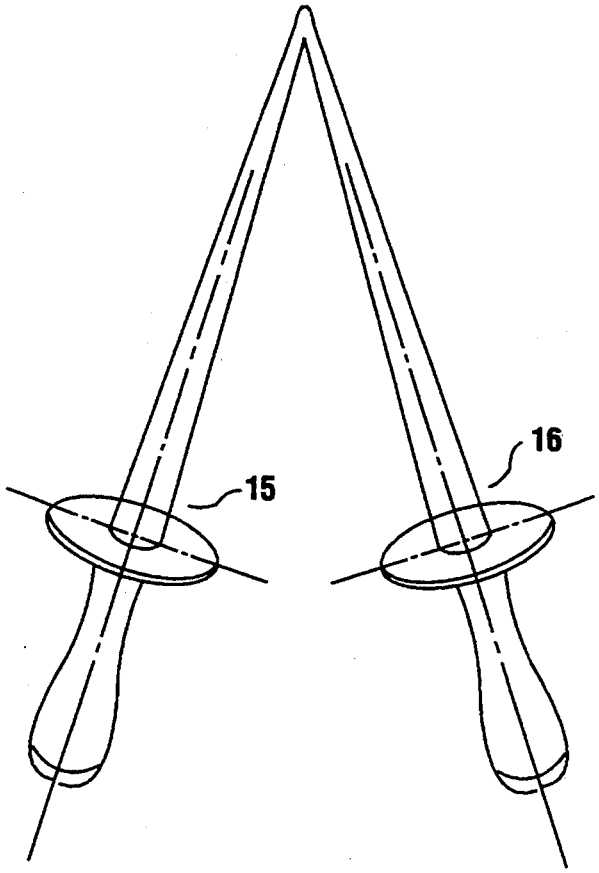
FIG. 5 illustrates a third embodiment of the launching device.

Referring now to FIG. 5, there is shown another embodiment of the instant invention in which the launching device is equipped with hand protectors 15 and 16 attached to, or made part of, the launching handles.

Figure 6:
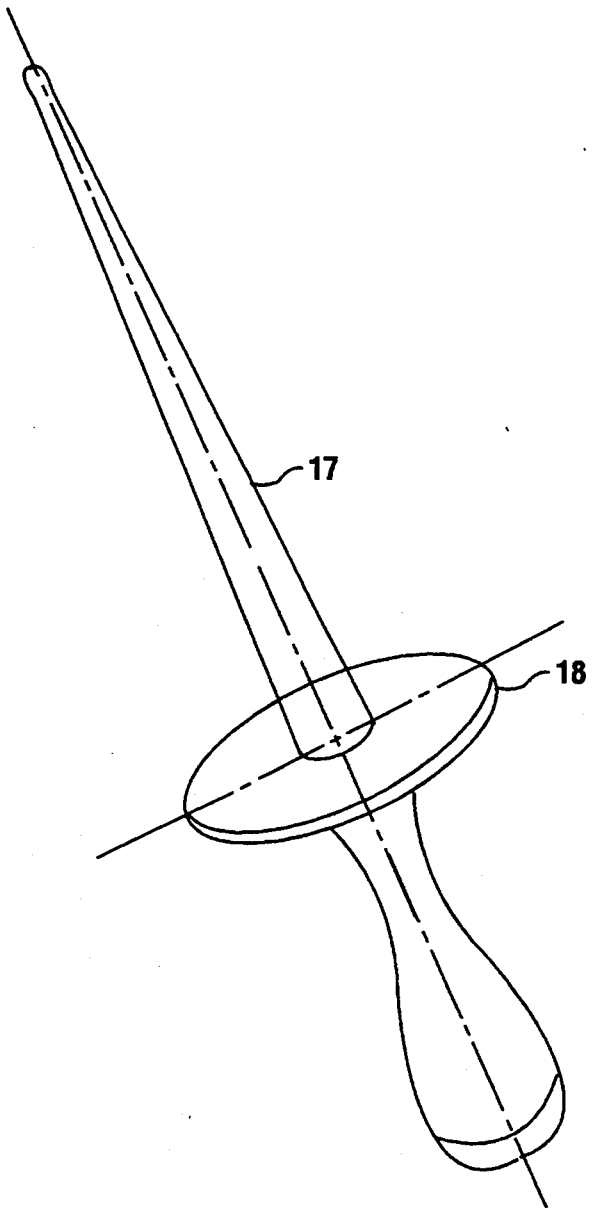
FIG. 6 illustrates a launching device comprising a single rod.

Similarly, FIG. 6 shows a launching device consisting of a single rod 17 which may also include hand protector 18. With a single rod launching device, the ring and attached flight stabilization member is thrown towards an opposing player, or target, rather than the rods of the launching device being rapidly separated from each other.

Figure 7:
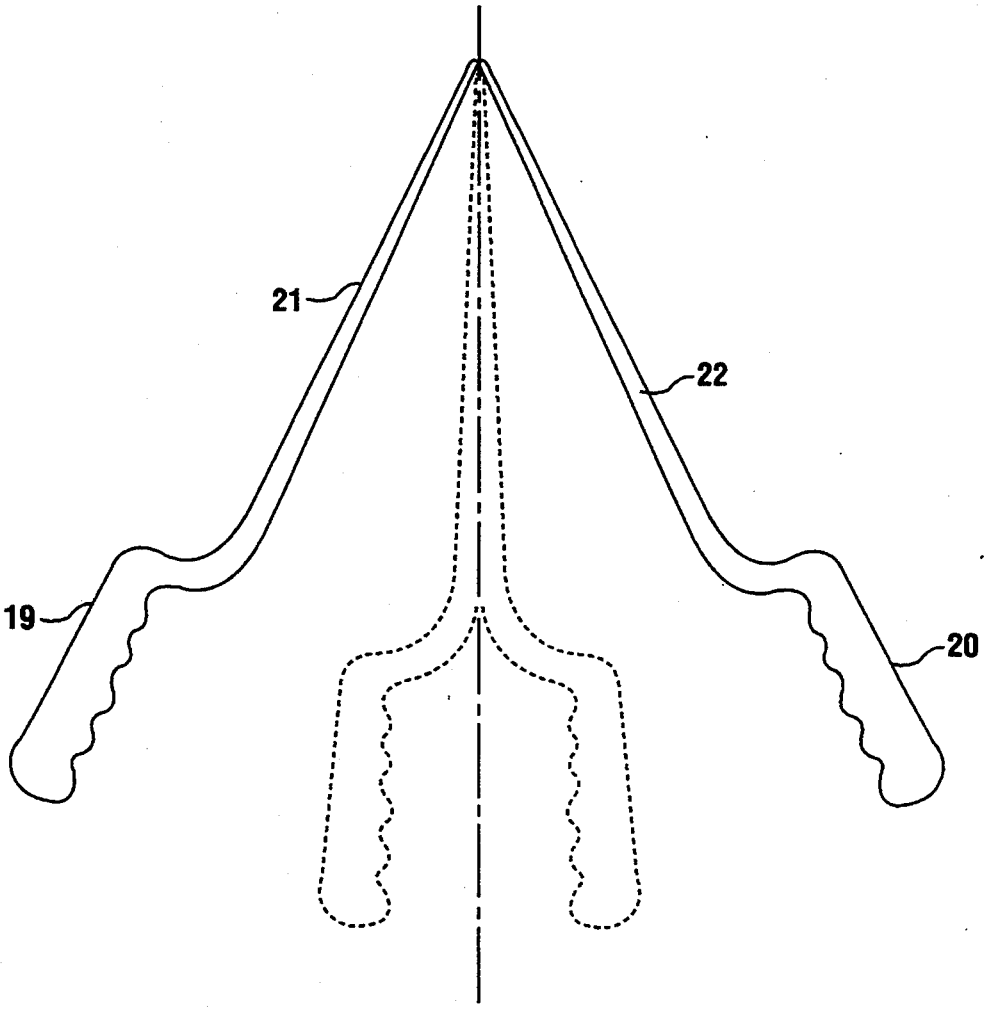
FIG. 7 illustrates a fourth embodiment of the launching device.

FIG. 7 shows an alternative launching device in which gripping handles 19 and 20 are offset from rods 21 and 22. The purpose of this offset is to allow more room for the hands of a player to grip the launching device.

Figure 8B:
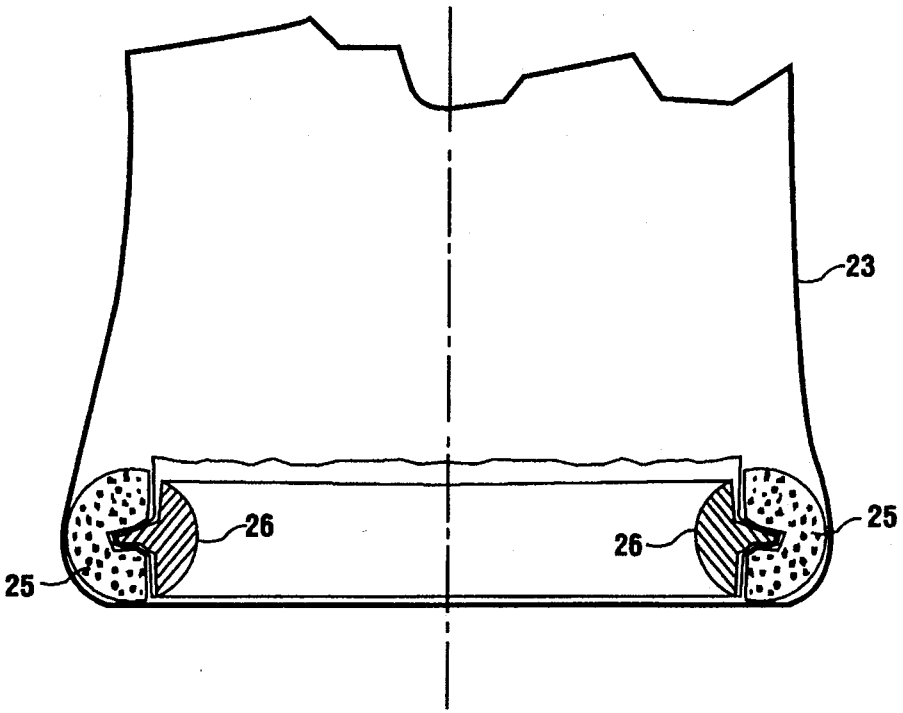
FIGS. 8A and 8B illustrates one manner of attaching the flight stabilization member to the ring.
Figure 8A:
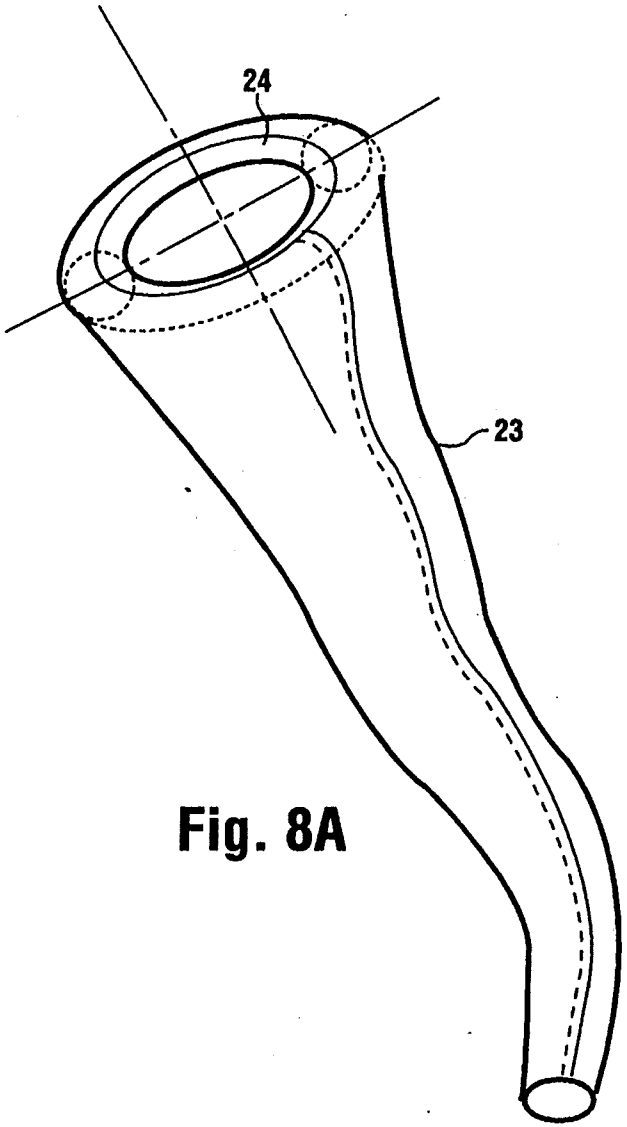

FIGS. 8A and 8B illustrate one manner in which a flight stabilization member, such as elongated tubular member 23, can be connected to ring 24; and also one manner in which to provide increased safety when utilizing the game apparatus of the instant invention. More particularly, ring 24, in FIG. 8A, is comprised of a first outer ring 25 made of a soft pliable material so that if outer ring 25 strikes an opposing player, injury will not result. In contrast, inner ring 26 may be made of a much harder low friction material to provide the low friction interface between the launching device and ring 24. In this manner, the ring 24 and the attached flight stabilization member can be launched at great speed without fear of injury to an opposing player. This is shown in FIG. 8B.

Attachment of tubular member 23 to ring 24 can be accomplished in this embodiment by inserting the material of the tubular member between outer ring 25, and inner ring 26, and "snapping" the two rings together as shown in FIG. 8B. This, of course, will securely attach the material of tubular member 23 to ring 24.

Figure 9E:
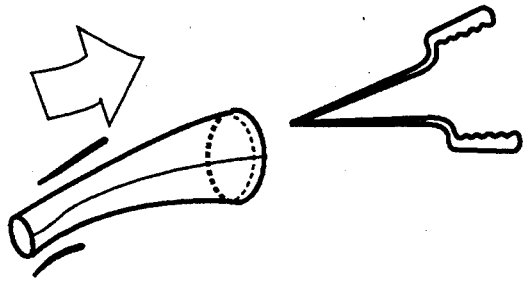
FIGS. 9A–9E illustrates a launch and retrieval sequence of the game apparatus of the instant invention.
Figure 9D:
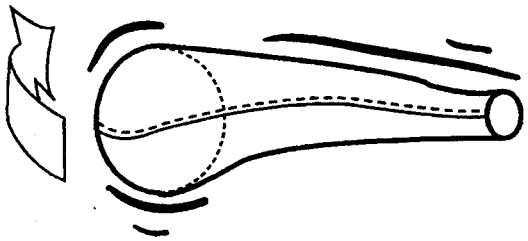
Figure 9C:
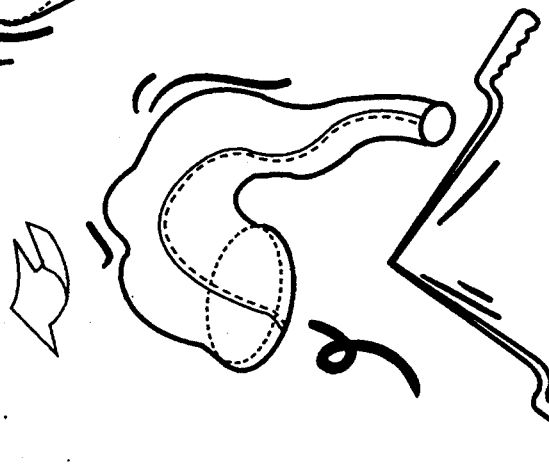
Figure 9B:
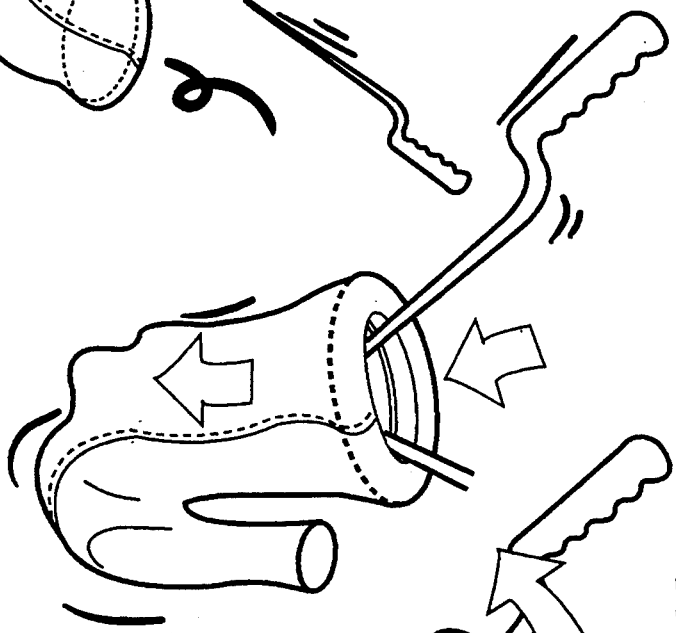
Figure 9A:
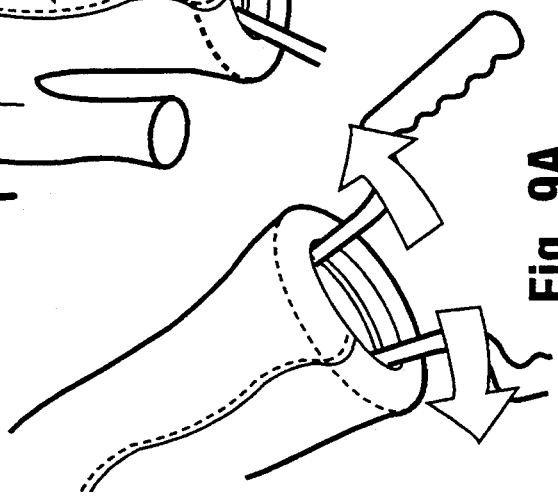

Referring now to FIGS. 9A–9E, there is shown a launch and retrieval sequence for one embodiment of the game apparatus of the instant invention. More particularly, the launching device is inserted into the ring and attached flight stabilization member as shown in FIG. 9A. The gripping handles of the launching device are moved rapidly away from each other as shown in FIG. 9A, and the device is launched in an upward direction as shown in FIG. 9B.

Due to the weight of the ring, and the flight characteristics of the flight stabilization member, the device begins to turn in FIG. 9C so as to point the ring at a target or an opposing player. The device completes the turn in FIG. 9D, and approaches the launching device of the opposing player in FIG. 9E. The opposing player then catches the ring and attached flight stabilization member, and relaunches the device towards the opposing player wherein the play sequence is repeated.

Figure 10B:
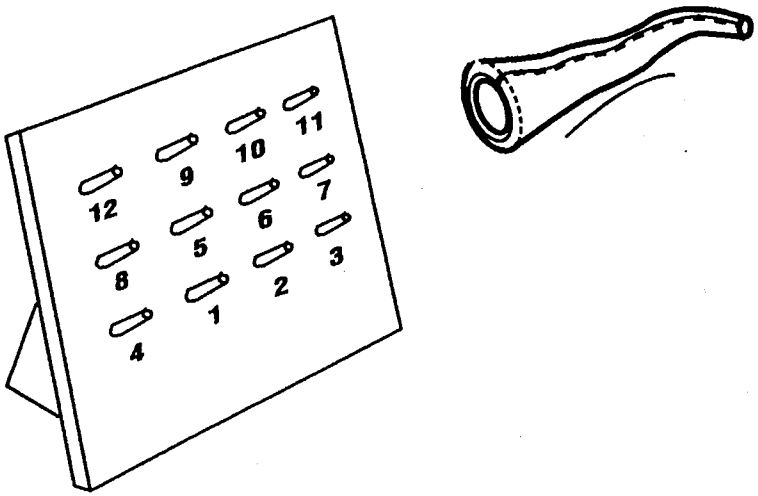
FIGS. 10A and 10B illustrate alternative games that may be played with the game apparatus of the instant invention.
Figure 10A:
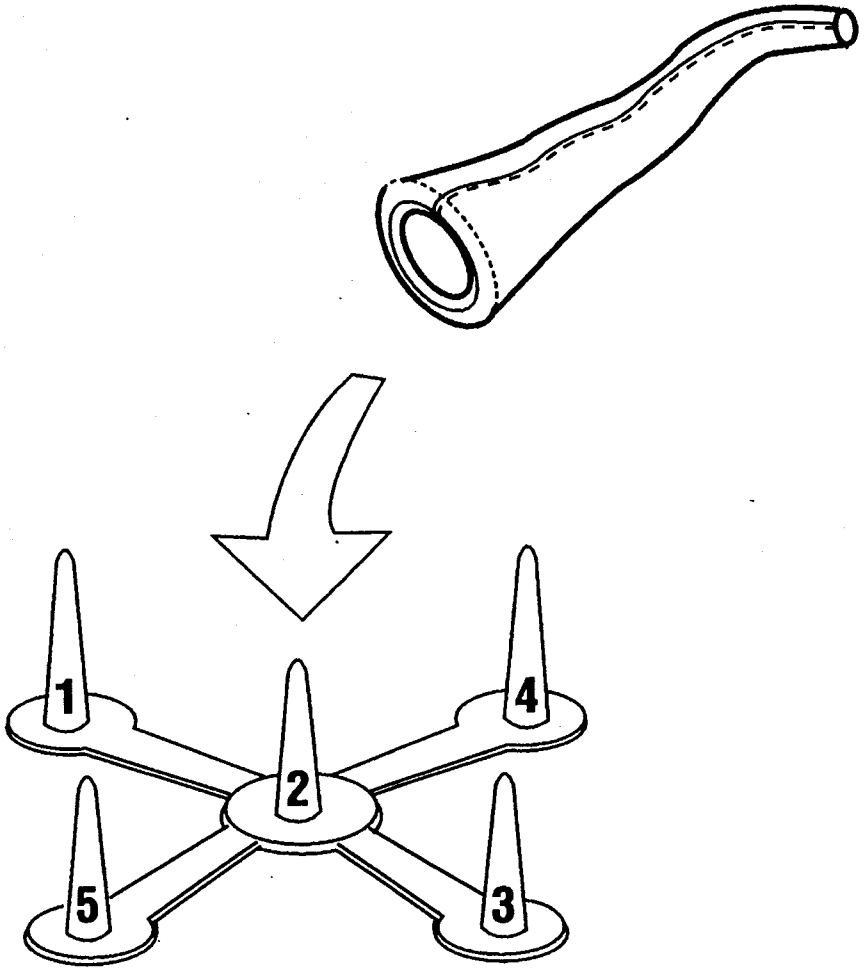

Referring now to FIGS. 10A and 10B, there is shown two alternative games which may be played with the inventive game apparatus. FIG. 10A illustrates a target arrangement comprising a plurality of horizontal pegs towards which the ring may be launched. It is, of course, understood that each peg would be associated with a particular score if the ring is successfully deposited on the peg with the launching device. Similarly, FIG. 10B illustrates a series of essentially vertical pegs which game would be played in a similar manner to the game described above.

Figure 11:
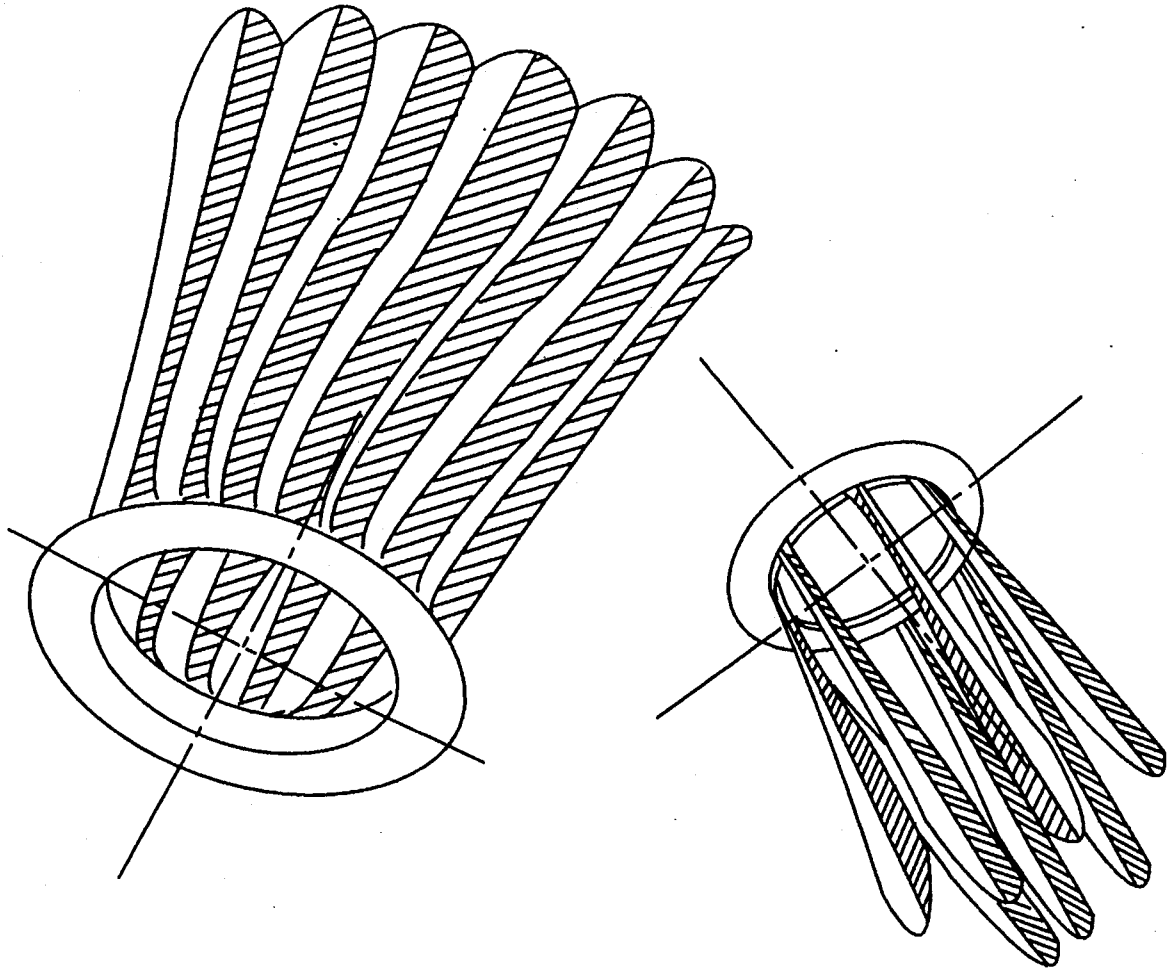
FIG. 11 illustrates an alternative flight stabilization member.

Referring now to FIG. 11, there is shown an alternative flight stabilization member, wherein an arrangement of flight stabilization feathers are attached to the launching ring. It is to be understood that although the instant invention requires a flight stabilization member for launching and retrieving the ring, any suitable means can be used such as the features shown in FIG. 11, or the elongated tubular member shown in FIG. 1.

Figure 12A:
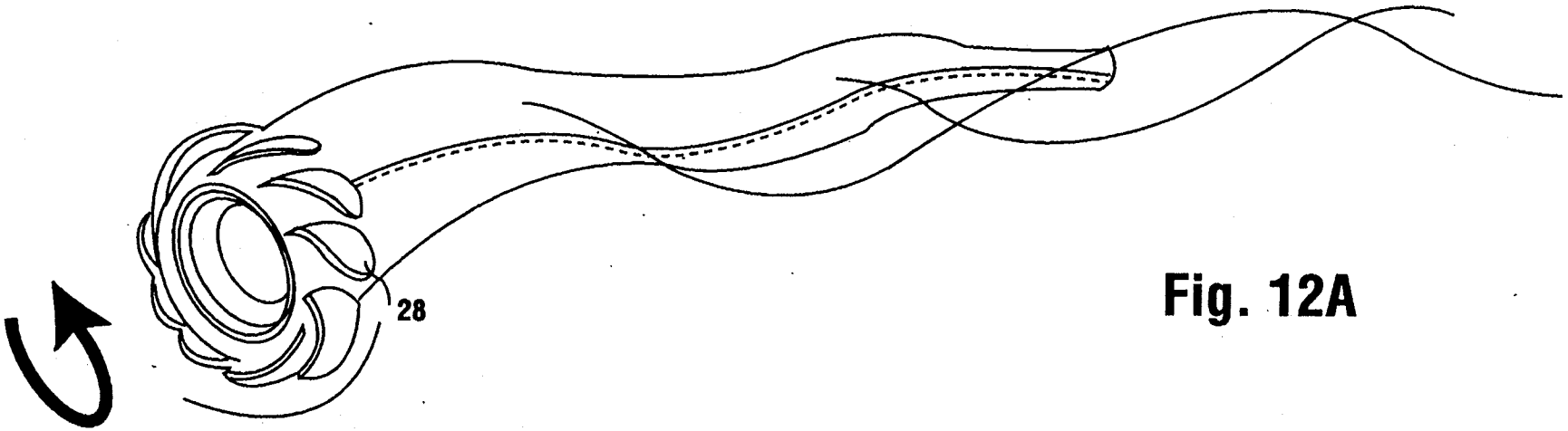
FIGS. 12A and 12B illustrate two other alternative embodiments of the instant invention.
Figure 12B:
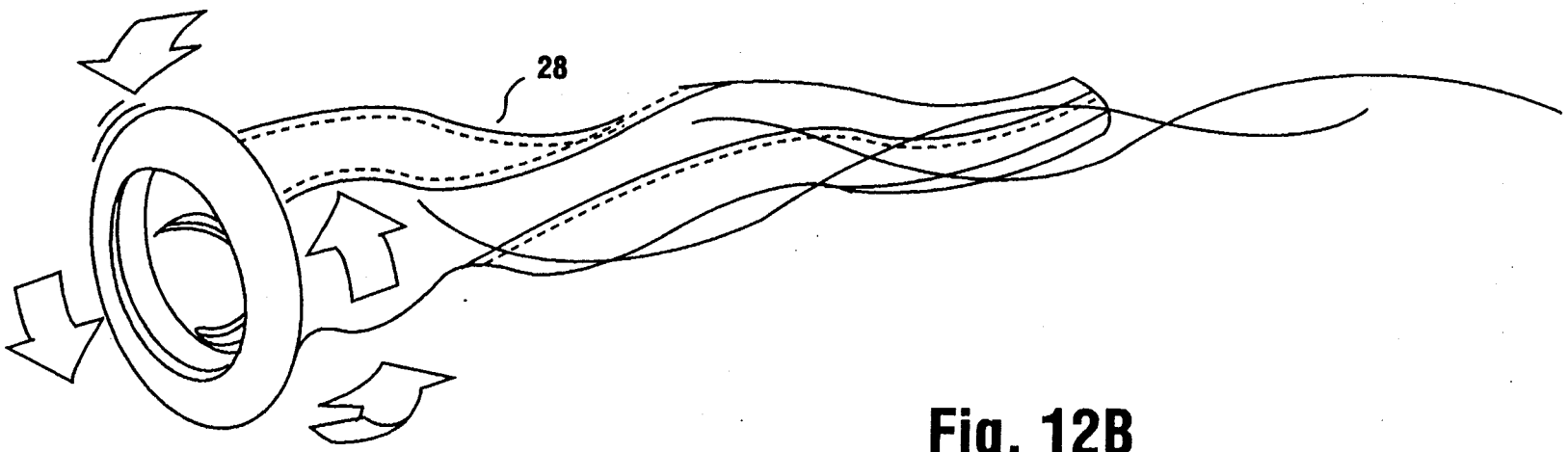

FIGS. 12A and 12B illustrate two further embodiments of the instant invention. In FIG. 12A, the ring of the invention is fitted with wings 27, which will cause the entire device to rotate during flight, thus adding to the play value of the inventive game apparatus. Similarly, in FIG. 12B, the elongated tubular member 28 is sewn in such a fashion that the wind passing through the ring causes the entire device to rotate during flight.

The foregoing disclosure and description of the invention is illustrative and exemplary thereof, and various changes in the size, shape and materials, as well as in the details of the illustrated construction, may be made within the scope of the appended claims without departing from the spirit of the invention.

What is claimed is:

1. Game apparatus comprising:

a ring having an elongated tubular flight stabilization member attached thereto, said elongated tubular flight stabilization member having a first diameter substantially equal to said ring diameter at a first end attached to said ring and a second diameter, substantially equal to or smaller than said first diameter at a second end not affixed to said ring, said elongated tubular flight stabilization member being comprised of a flexible material; and at least one launching device being inserted into said ring for launching said ring and the attached elongated tubular flight stabilization member.

2. Game apparatus in accordance with claim 1, wherein said launching device comprises a pair of longitudinally extending members joined together at a first end of each of the extending members, said joined first end being inserted into said ring for launching.

3. Game apparatus in accordance with claim 2, wherein gripping handles are affixed to a second end of each of said extending members, said gripping handles being rapidly separated from each other by said player to launch said ring.

4. Game apparatus in accordance with claim 3, wherein a first one of said extending members is a cord, and a second one of said extending members is a flexible rod.

5. Game apparatus in accordance with claim 4, wherein both of said extending members are flexible rods.

6. Game apparatus in accordance with claim 5, wherein an interior surface of said ring and at least one of said extending members is comprised of low friction material.

7. Game apparatus in accordance with claim 1, wherein said flexible material is comprised of fabric.

8. Game apparatus comprising:

a ring having an elongated tubular flight stabilization member attached thereto, said elongated tubular flight stabilization member having a first diameter substantially equal to said ring diameter at a first end attached to said ring and a second diameter, substantially equal to or smaller than said first diameter at a second end not affixed to said ring, said elongated tubular flight stabilization member for maintaining said ring generally perpendicular to its direction in flight when launched by a first player; and at least one launching device, said launching device including a pair of longitudinally extending members joined together at a first end of each of the extending members, said joined first end being inserted into said ring for launching.

9. Game apparatus in accordance with claim 8, wherein said ring and attached flight stabilization member is launched towards a game target.

10. Game apparatus in accordance with claim 8, wherein said ring is comprised of a first outer ring of a generally soft material, and a second ring of a generally hard, low friction material.

11. Game apparatus in accordance with claim 10, wherein said first outer ring includes a circumferential recess on an inner surface thereof, and said inner ring includes a circumferential protrusion on an outer surface thereof.

12. Game apparatus in accordance with claim 11, wherein said elongated tubular flight stabilization member is comprised of flexible material which is inserted between said first outer ring and said second ring, and said protrusion on said second ring is inserted into said recess on said outer ring.

13. Game apparatus in accordance with claim 12, wherein said elongated tubular flight stabilization member varies in length between 250 and 900 millimeters.

14. Game apparatus in accordance with claim 13, wherein said ring varies in weight between 50 and 180 grams.

15. Game apparatus comprising:

a ring having an elongated tubular flight stabilization member attached thereto, said elongated tubular flight stabilization member having a first circumferential area substantially equal to said ring circumferential distance at a first end attached to said ring and a second circumferential distance, substantially equal to or smaller than said first circumferential distance at a second end not affixed to said ring, said elongated tubular flight stabilization member being comprised of a flexible material; and at least one launching device being inserted into said ring for launching said ring and the attached elongated tubular flight stabilization member.

* * * * *